United States Patent [19]

Vidal

[11] 4,440,527

[45] Apr. 3, 1984

[54] MARINE STRUCTURE

[76] Inventor: Henri C. Vidal, 8 bis Blvd. Maillot, 92200 Neuilly sur Seine, France

[21] Appl. No.: 304,625

[22] Filed: Sep. 22, 1981

[51] Int. Cl.[3] ..... E02D 29/02

[52] U.S. Cl. ..... 405/284; 405/262

[58] Field of Search ..... 405/284, 262

[56] References Cited

U.S. PATENT DOCUMENTS 2,018,423 10/1935 Smith ..... 405/262

4,343,571 8/1982 Price ..... 405/284

*Primary Examiner*—Dennis L. Taylor

*Assistant Examiner*—John A. Gungor

*Attorney, Agent, or Firm*—Burns, Doane, Swecker & Mathis

[57] ABSTRACT

An internally stabilized earth wall is disclosed along with facing elements suitable for construction of that wall in a wet marine environment. The wall elements include footer panels and wall panels, each of which is provided with a pivotally attached planar array of reinforcing members. The reinforcing members are hingedly mounted so as to be lowered in a vertical plane to a substantially horizontal posture on top of a lift of particulate material. According to the method, the footer panels are suspended and properly positioned by a stationary crane while crushed stone is dumped into position beneath the footer so as to support it. With the footer in position, the wall is erected by guiding each wall panel of a course into position on top of the associated footer panel and backfilling the wall panel by depositing a layer of particulate material subsequently lowering at least one array of reinforcing members and repeating those steps until the last layer of reinforcing members has been positioned on top of a lift of particulate material. When the top of the wall has attained the appropriate elevation above the water surface, a cap member is integrally cast in place.

7 Claims, 12 Drawing Figures

MARINE STRUCTURE

BACKGROUND OF THE INVENTION

The present invention relates generally to marine structures. More particularly, the present invention concerns a wall suitable for use in the construction of wharves, docks, piers, and the like.

In the past, marine structures have been fabricated using various methods. One such method involves driving pilings into the sea bed adjacent to the shore. Typically the pilings are driven in a straight line which defines the eventual contour of the wharf, pier or similar structure to be built. When all the pilings have been driven to a suitable depth and adequately braced, a channel is dredged adjacent to the pilings to accommodate seagoing vessels.

Pilings are not well-suited for use in rocky areas or in areas where the bottom material is especially soft. In the former case it is difficult to drive pilings through rock; as to the latter case, it is difficult to maintain channels adjacent to the wharf without continually dredging them clear.

Another type of marine wall construction involves the use of caissons. The caissons are first fabricated and then floated into position where the marine wall is to built. When in position, the caissons are sunk by use of appropriate kinds of ballast. The sinking operation, however, is tricky because the caissons must be sunk so as to be in proper alignment with the previously positioned and submerged caissons. The space between the caissons and the shore, for example, is then filled with rocks or other material in order to bring the coastal area up to the marine wall.

The caisson construction method is, however, difficult, costly and time consuming.

Another form of marine wall construction involves the use of sheet pilings. The sheet pilings are individually driven adjacent to one another in order to define the front wall of the marine structure. When all the pilings have been driven, the area between the piling and the shore line is then filled with suitable material so as to bring a level surface to the edge of the pilings. In addition, some steps are ordinarily taken to tie back the upper ends of the pilings in a conventional fashion to prevent earth pressure from forcing the pilings outwardly away from the shore. Like the conventional piling method, the sheet piling method is also not well suited to all bottom conditions. Moreover, the sheet piling method is extremely expensive to use since a continuous wall of individually driven pilings is required. Moreover, with the cost of materials in today's economy, steel is not particularly economical to use.

Concrete walls, cast in place, have also been used for marine structures. This method of construction is, however, very expensive and time consuming. For example, a coffer dam is usually required before the construction can commence. And, the foundation must often be dug to bedrock.

One other method of erecting marine walls involves the use of hexagonal panels provided with rearwardly extending truss like members. The facing panels were submerged and placed on a previously submerged footer. The region behind the facing panels is thereafter filled with crushed rock or gravel which interacts with the trusses to maintain the wall in it configuration. Such a wall is disclosed in U.S. Pat. No. 4,045,965 which issued to Henri Vidal on Sept. 6, 1977.

As can be seen from the patent, that earlier construction required the handling and positioning not only of wall panels, but also of the truss members which were then attached to the rear panels. Moreover, a separate vertical truss system was employed to position the horizontal trusses during the backfill procedure. Accordingly, even this more recent system is capable of significant and further improvement.

OBJECTS AND SUMMARY OF THE INVENTION

In view of the foregoing deficiencies of existing marine wall structures, it is an object of this invention to overcome those shortcomings.

In addition, it is an object of the present invention to provide a marine wall construction in which virtually all construction steps can be performed from the water surface while only using conventional equipment.

A further object of the present invention is to provide a novel assembly for use in erecting a marine wall.

In order to erect a wall in accordance with the present invention, footer panels are individually installed in a submerged location. Wall panels are thereafter erected on the footer panels. After the first course of wall panels is positioned and fixed horizontally with respect to the footer panels by a pinned connection, a first layer of particulate material is deposited behind the wall panels. Subsequently, an array of reinforcing members, which are pivotally connected to the wall panels themselves, is lowered into generally horizontal position on top of the first layer of particulate material. Thereafter, additional layers of particulate material are deposited and an additional array of reinforcing members is pivotally lowered into position on the top of each corresponding layer.

In this fashion, the wall structure becomes rigid as it is being erected.

Subsequent courses of wall panels are positioned relative to the lower or first course of wall panels and footer panels. And additional layers of particulate material and arrays of reinforcing members are intercolated so as to support each additional course of panels.

When the last course of wall panels is positioned, the elevation of the top of the wall will be above the high tide and will be at the elevation selected for the surface of the sea wall. At that point, a cap member, or coping, is cast in place on the top of the last course of wall panels.

From the foregoing, it will be seen that all of the necessary steps in erecting the wall can be conducted from the surface of the water.

The novel wall panel assemblies, include a plurality of reinforcing members which are pivotably attached to the reinforced concrete wall panels so as to swing in a generally vertical plane. In this fashion, those persons erecting the wall can determine from the surface of the water where strips have been positioned and where strips are yet to be positioned. Accordingly, as particulate material is placed, the presence and absence of reinforcing members protruding from the surface of the water will give an indication of the progression of the wall both laterally and vertically.

This invention incorporates the principles of internally stabilized earth construction methods as disclosed in U.S. Pat. Nos. 3,421,326 and 3,686,873, and the disclosures of those patents are incorporated herein by reference thereto.

BRIEF DESCRIPTION OF THE DRAWINGS

Many other objects of the present invention, as well as those mentioned above, will be apparent to those skilled in the art when this specification is read in conjunction with the accompanying drawings wherein like reference numerals are applied to like elements and wherein.

DESCRIPTION OF THE PREFERRED EMBODIMENTS

Figure 1:
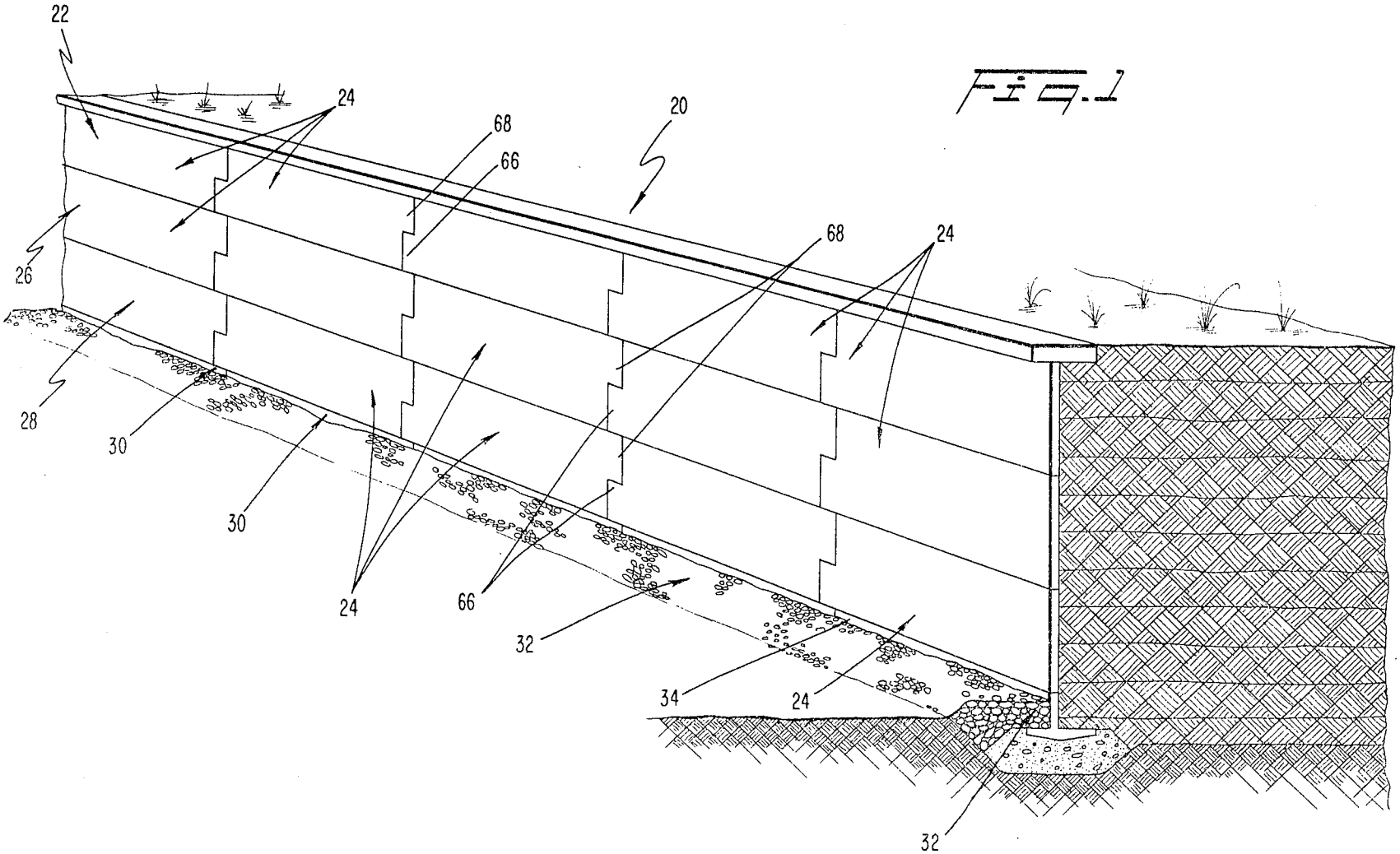
FIG. 1 is a pictorial elevational new front of a marine wall erected in accordance with the present invention.

When completed, a marine wall 20 constructed in accordance with the present invention (see FIG. 1) will project above the water surface with at least the top portion of the last course 22 of wall panels 24 showing. The last course of panels 22 is positioned vertically on top of the next preceding course of panels 26 which in turn is placed on top of the preceding course of panels 28.

At the bottom of the wall and supporting all of the courses of wall panels, 22, 26, 28 is a course of footer panels 30.

Submerged at the front of the wall, and running along the footer panels 30, suitable ballast 32 such as rocks may be disposed. These rocks protect the footer panels and the footer panel foundation from erosion as well as from damage from the hulls of vessels which may be positioned alongside the marine wall 20.

Each footer panel 30 is precast concrete and typically will have a length approximately twice that of a corresponding wall panel 24. In this fashion, some flexibility is provided in the wall in the vertical plane containing the wall. However, by positioning the joints at spaced intervals, only that degree of flexibility necessary to accommodate settling is allowed.

The footer panels 30 have an inverted T-shaped cross-sectional configuration (as seen in FIG. 1). A vertically upstanding portion 32 has a front surface 34 which is generally planar. The bottom portion 36 (FIG. 2) of the footer panel 30 extends both forwardly of the wall and rearwardly of the wall itself. The bottom surface 38 of the bottom portion 36 may be provided with as dihedral angle to facilitate the rock filling operation. The dihedral angle also helps hold the footing panel on the stone base 40 when vertical support for the footer panel 30 is released during the wall assembly.

Figure 2:
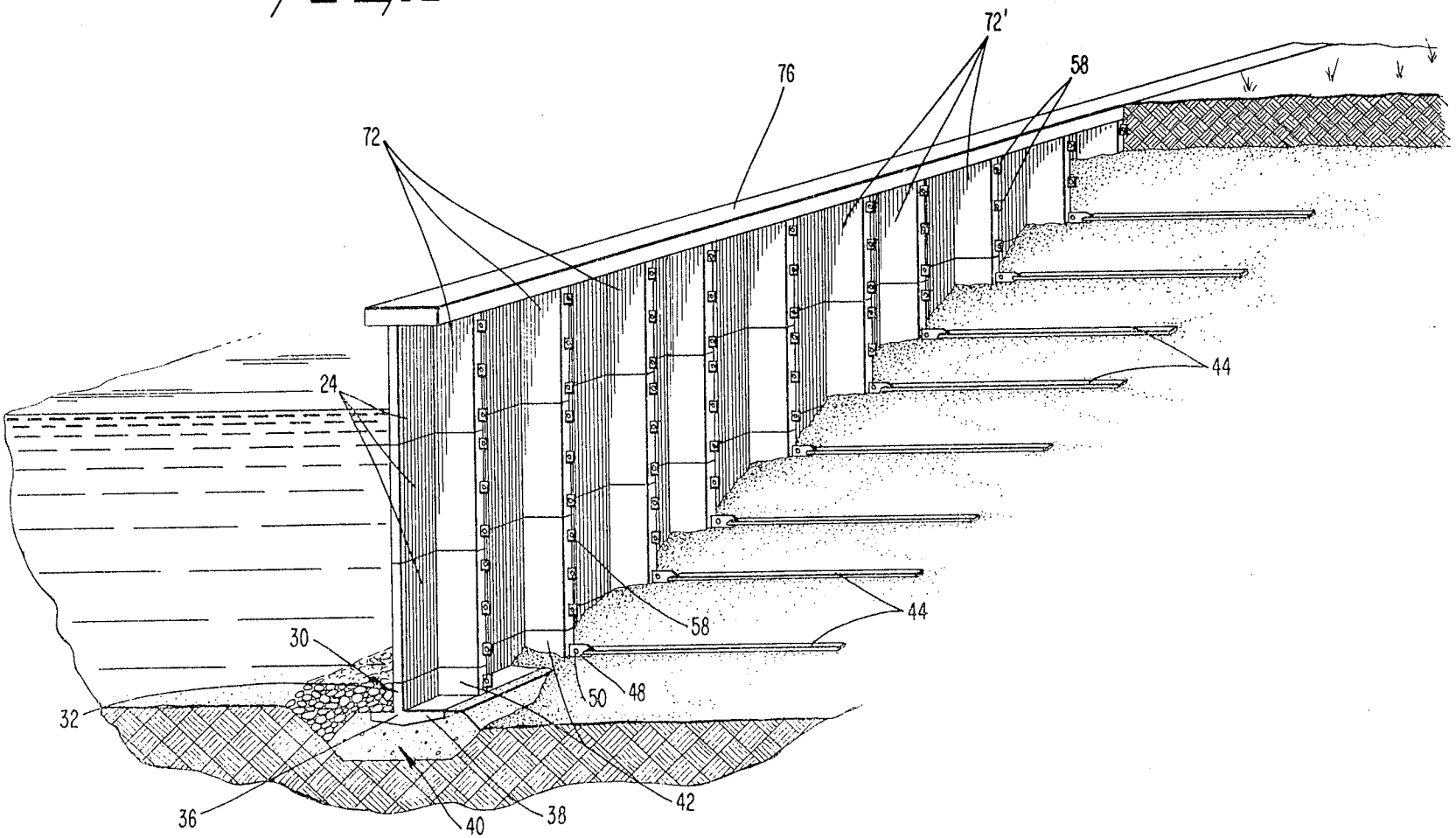
FIG. 2 is a pictorial rear view of the marine wall with portions of the backfill and reinforcing members removed to show features of the wall as well as features of the construction method.

It will also be noted from FIG. 2 that projecting from the rearward face of the footer panel 30 are a plurality of buttress portions 42. In fact, each footer panel 30 has six of these buttress portions 42 projecting rearwardly therefrom.

Figure 5:
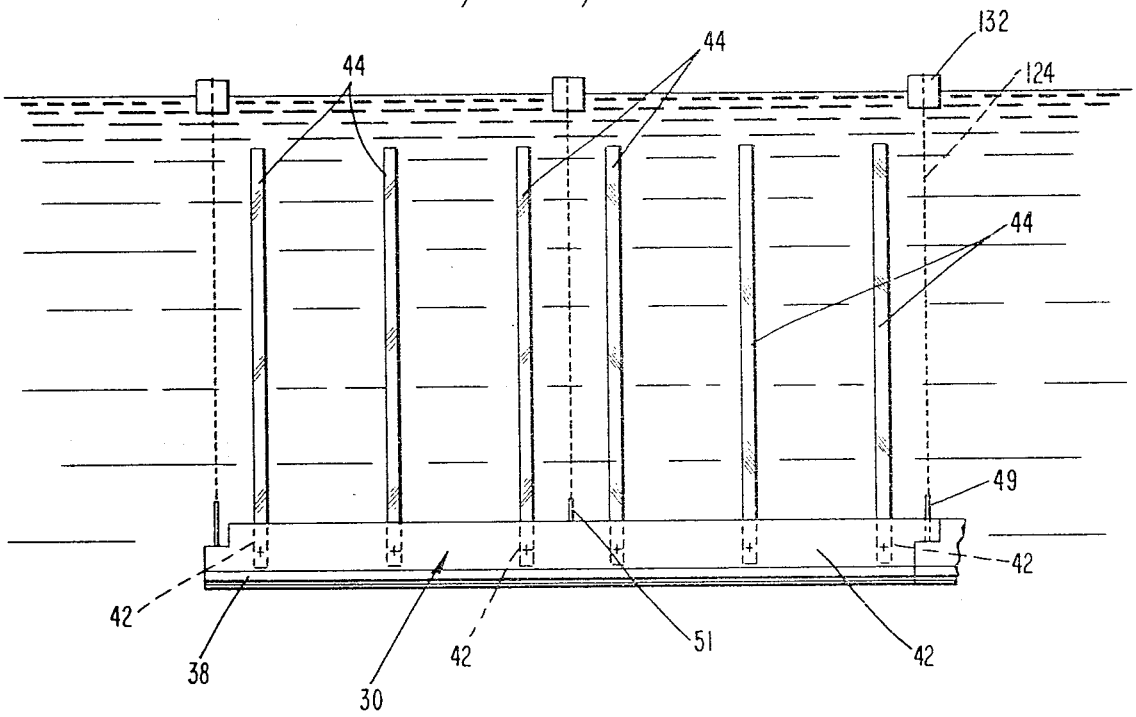
FIG. 5 is a front elevational view of the footer panels.

Turning briefly now to FIG. 5, the details of the joint between adjacent footer panels 30 is more readily seen. In particular, each end of the footer panel 30 is provided with a projecting portion 44, 46. The height of each projecting portion 44 in the vertical direction is the same for all of the footer panels 30. Similarly, the height of all the projections 46 in the vertical direction is the same for all of the footer panels. Moreover, the total height in the vertical direction for the projections 44, 46 of the footer panels 30 is the same as the total vertical height for the footer panel. In addition, the projection 46 is provided with a vertical bore which receives a corresponding pin 49 which is securely mounted in the projecting portion 44. The center of the footer panel 30 is also provided with a vertically projecting pin 51.

As seen in FIG. 5, the bore in projecting portion 46 receives the pin 49 from a projecting portion 44 of an adjacent footer panel. The thickness of the flanges of the bottom portion 38 abut against one another and therefore control the amount of misalignment which the footer panels will accommodate in the horizontal plane. Similarly, the abutting surfaces at the end of the projection 46 and the projection 44 serve to limit the amount of misalignment in the vertical plane of the footer panel 30. In this fashion, when the footer panels 30 have been positioned, a very straight and uniform footer is established to support the marine wall.

Each of the buttress portions 42 has pivotally connected thereto a corresponding reinforcing strip 44 which is mounted for movement in a vertical plane.

Figure 7:
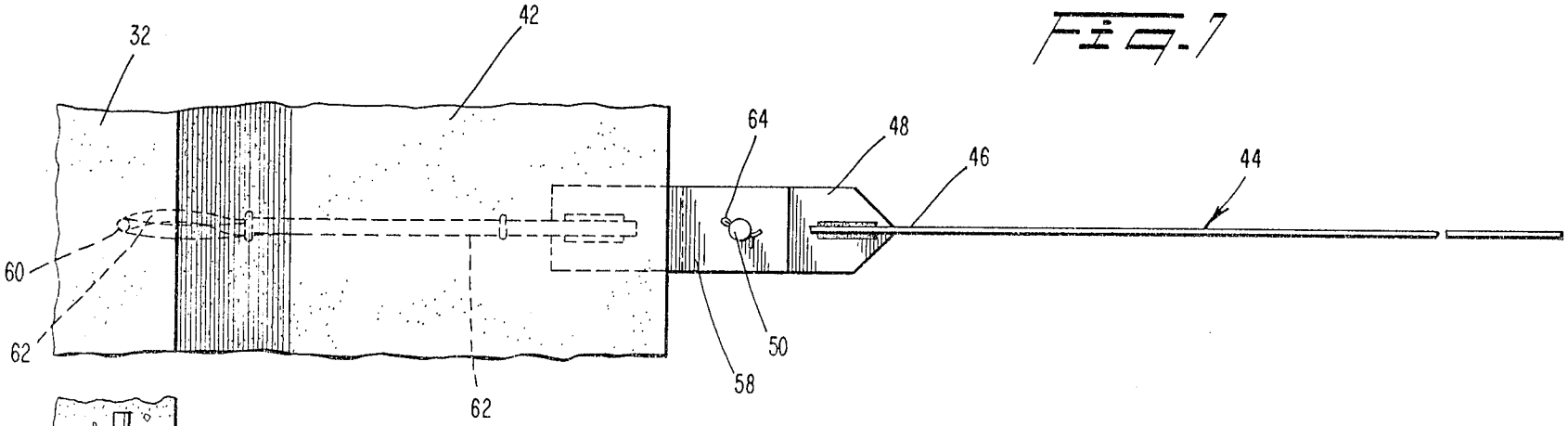
FIG. 7 is an enlarged side view of the pivotal connection between a panel and a reinforcing member.
Figure 8:
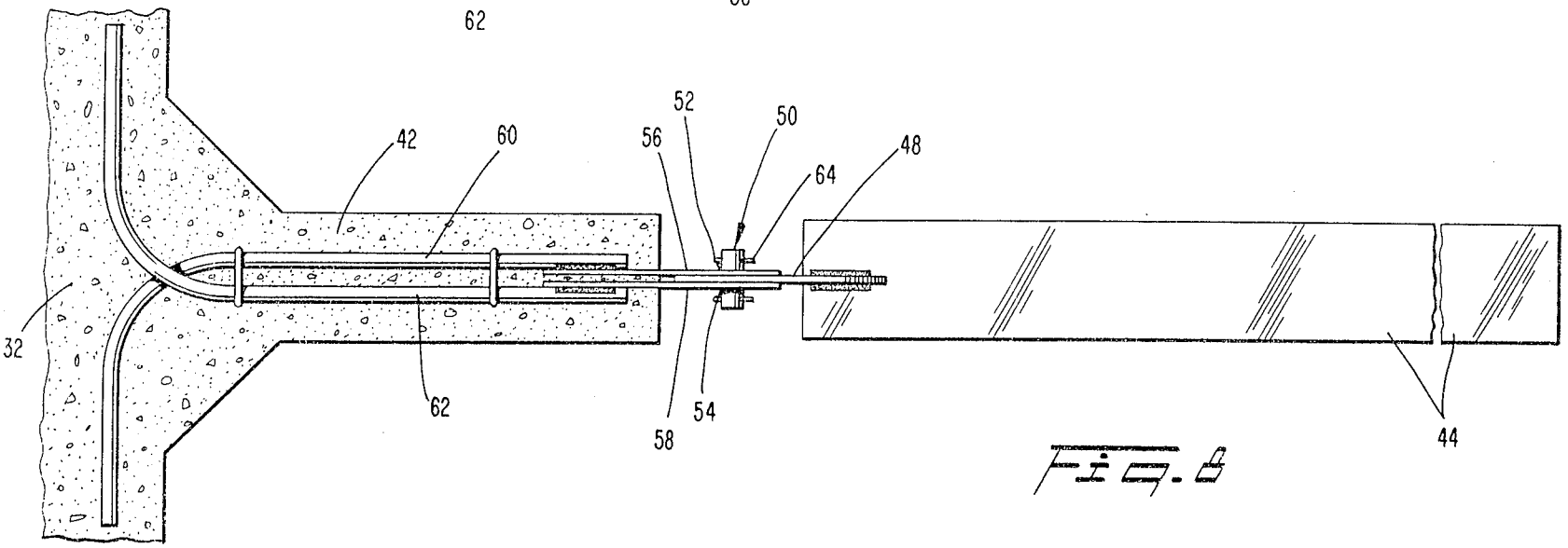
FIG. 8 is a plan view of the connection in FIG. 7.

Turning now to FIG. 7, the details of the pivotal connection between the reinforcing strip 44 and the buttress portion 42 is illustrated more completely. Attached to one end 46 of the reinforcing member 44 is a perpendicularly oriented plate 48. The plate 48 is joined to the end 46 in any suitable conventional manner, such as by means of welding. In this connection, either or both of the members 46, 48 can be notched to accommodate the thickness of the corresponding member so as to effect the joint. An end portion of the plate 48 is provided with an aperture 50 through which a pin assembly 50 passes. The pin assembly 50 also passes through a pair of aligned apertures 52, 54 (FIG. 8). Each aperture 52, 54 is contained in an end portion of a corresponding strap member 56, 58 which projects from the surface of the buttress portion 42.

Each of the strap members 56, 58 has a corresponding portion which is imbedded within the buttress portion 42 of the footer panel. During fabrication, the strap members 56, 58 are each welded to a corresponding, reinforcing rod 60, 62 which is embedded in the buttress portion 42.

The pin assembly 50 includes a suitable conventional device, such as a cotter pin 64 (see FIG. 7), to prevent the pin assembly 50 from accidently slipping out of engagement between the strap members 56, 58 and the transition member 48. In this manner, accidental disenagagement of the reinforcing member 44 from the hinged connection is avoided.

Figure 10:
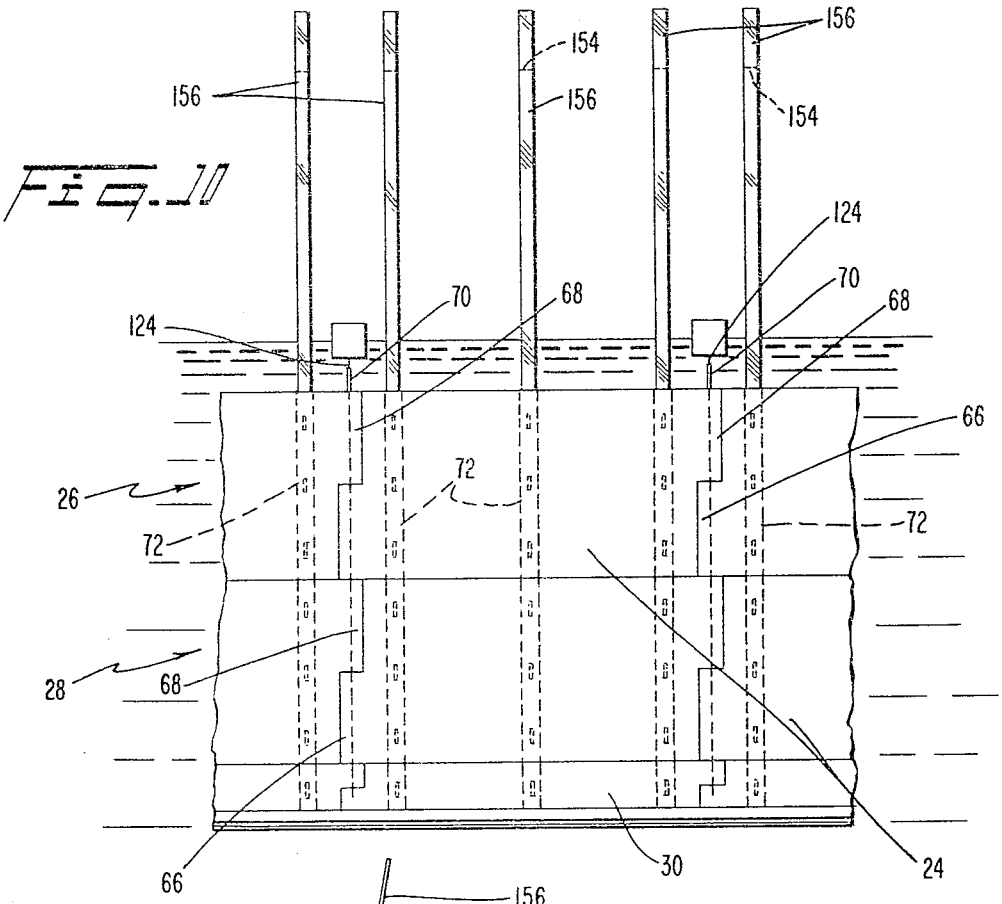
FIG. 10 is a front elevational view at a subsequent stage of construction.

The wall panels 24 are uniform in size and proportion. Accordingly, it will suffice to describe one wall panel 24 in detail. With reference again to FIG. 1, each wall panel 24 is generally rectangular in shape and is constructed from reinforced concrete. Along each vertical edge, each wall panel is provided with a projecting portion 66 or 68 on one side (FIG. 10), the projecting portion 66 extends from the bottom half of the wall panel 24. On the other side, the projecting portion 68 extends outwardly from the upper half of the wall panel. Each of the projecting portions 66, 68 is provided with a vertically extending bore to accommodate a corresponding pin 70. The pin 70 assures continued vertical alignment between the adjacent wall panels 24. Moreover, the pin 70 projects vertically upwardly to position the wall panels that are positioned vertically above. The projection 66 of the first course 28 of wall panels 24 receives the positioning pins 48 or 50 carried by the footer panel 30 (see FIG. 5).

The back of each wall panel 24 is provided with three vertically extending ribs 72. Horizontal spacing between the ribs 72 of the wall panels identically coincides with the horizontal spacing of the buttress portions 42 of the footer panel 30. In this fashion, additional buckling strength is provided for the wall assembly to resist horizontal thrusts directed against the front face.

Each vertical rib 72 of each wall panel 24 is provided with three equally spaced reinforcing members. For the sake of clarity, those reinforcing members are not illustrated in FIG. 2. However, the connection between each rib 72 and its associated reinforcing member is identical to that described above in connection with FIGS. 7 and 8. Accordingly, each wall panel assembly includes a plurality of nine reinforcing members which are hingedly connected so as to move in a vertical, plane perpendicular to the face of the wall panel.

At the top of the wall, a cast concrete cap 76 is formed. This cap integrally connects the adjacent wall panels 24. To effect this integral connection, the uppermost course of wall panels 24 may be provided with exposed portions of reinforcing rods such that, when the cap 76 is cast, those reinforcing rods are embedded in the cap.

Figure 3:
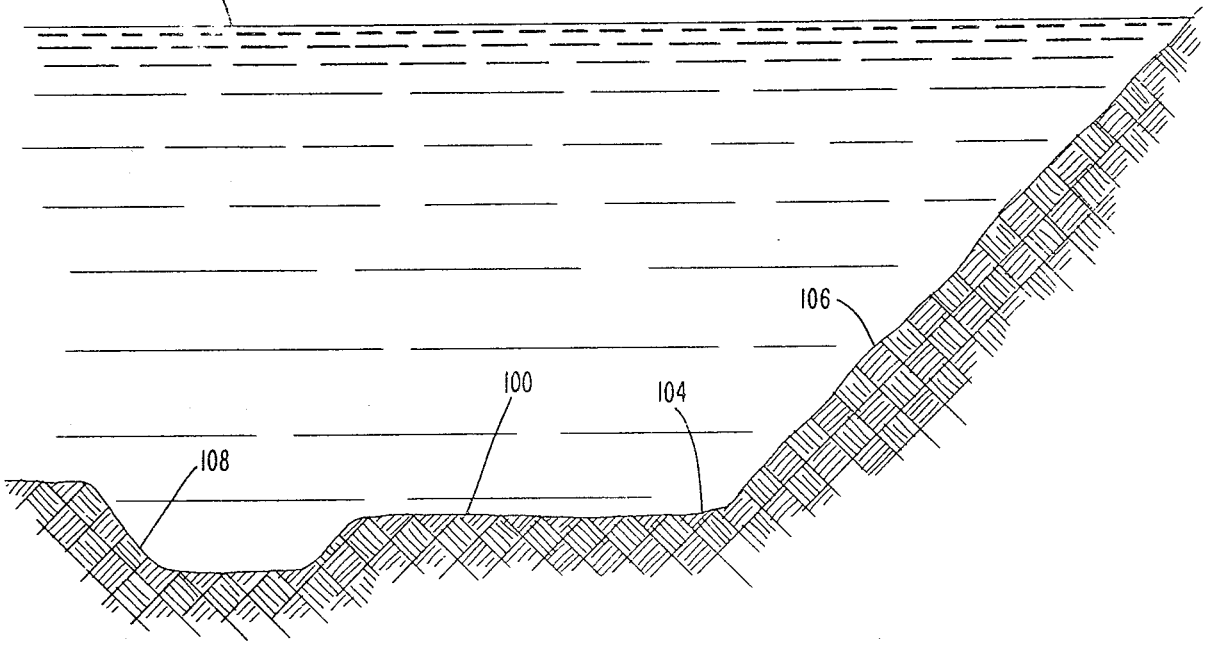
FIG. 3 is a cross-sectional view of a site prepared for a wall according to this invention.

As the essential elements of the wall have now been described, the method of erecting a wall in accordance with the present invention will now be described. For a marine wall of the type disclosed in this patent, the site preparation is comparatively simple. For example, the area around the existing shoreline is simply dredged to provide a contour such as that illustrated in FIG. 3. In particular, the ground 100, or sea bed, is dredged to an appropriate depth below the surface 102 of the water. A horizontal distance of approximately the height of the wall to be constructed must be provided behind the wall. Accordingly, the toe 104 of the dredged slope 106 must be properly located. With the initial dredging completed, a shallow trench 108 is dredged at the location where the marine wall is to be constructed.

Figure 4:
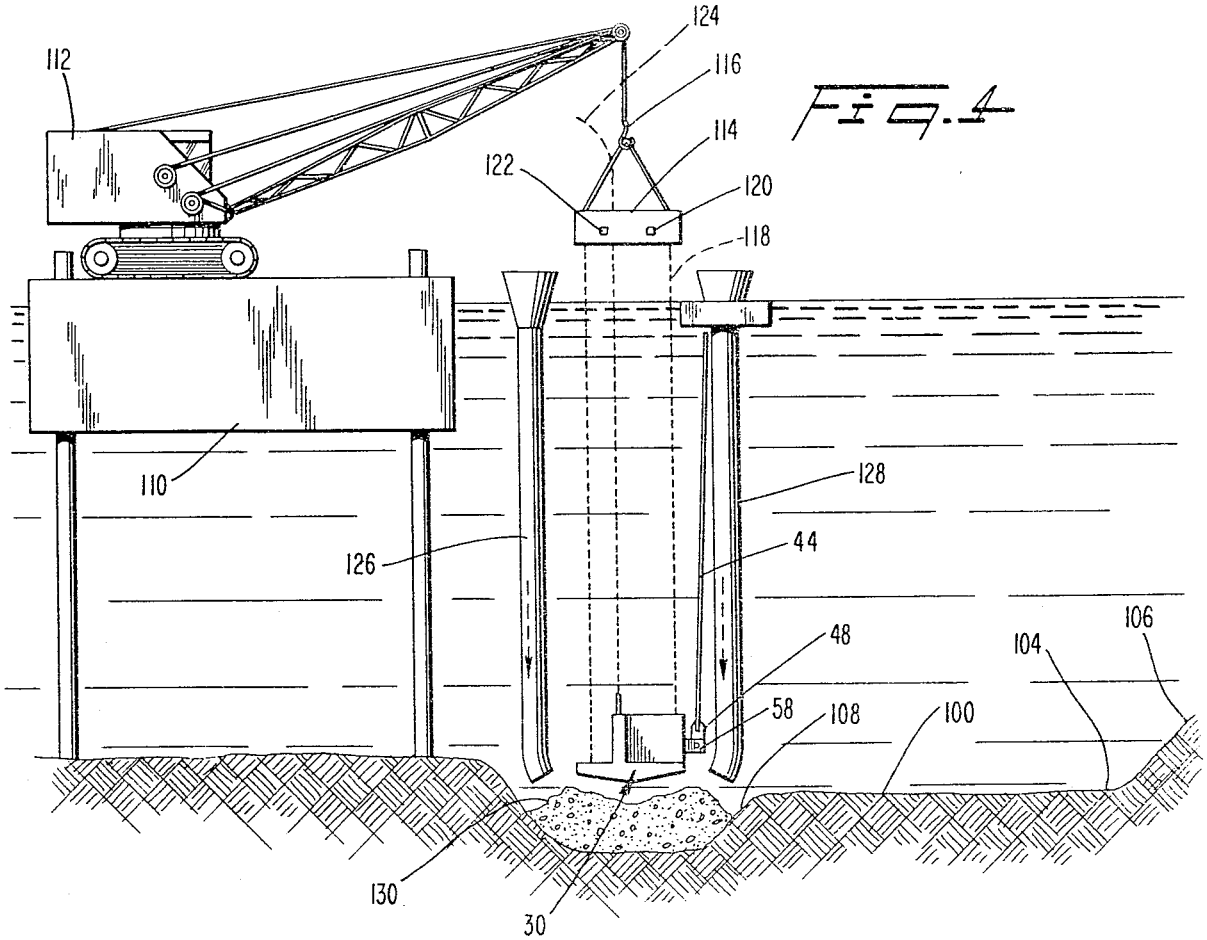
FIG. 4 is a schematic illustration of the placement of footer panels.

After these basic surface preparations have been effected, a temporary working platform 110 (FIG. 4) is positioned in a location parallel to the trench 108. The temporary working platform 110 may, for example, be a jack-up barge type of construction or a temporary structure erected on pilings and having sufficient strength to support the operations of a crane 112.

With a temporary working surface in position 110, a footer panel 30 is suspended from a spreader beam 114 which is carried by a hook 116 of the crane. The spreader beam 114 attaches to a lifting bridle 118 which is suspended therebelow and which is connected to the footer panel 30.

It is important to note that the spreader panel 114 is also provided with a pair of targets 120, 122. These targets are adapted to be sited from shore by a pair of laser beams. Thus lateral positioning as well as levelling of the spreader beam 114 can easily be effected. It is particularly noteworthy that the existence of two targets 120, 122 on the spreader beam makes it possible for the footer panel 30 to be oriented in two perpendicular vertical planes: one transverse to the footer panel and one parallel to the footer panel. In this fashion, the wall itself will not only be level, but in addition will also be vertically straight.

When the footer panel 30 is positioned above the trench 108, and is suspended there by the lifting sling 118, a positioning cable 124 extends vertically upwardly from each of the positioning pins 48, 50, which were discussed more fully above.

While the footer panel 30 is thus suspended, a pair of chutes or tremmies 126, 128 are used to direct crushed stone from the surface of the water to the trench 108 in position beneath the footer panel 30. Alternatively, suitable concrete could be used.

Figure 6:
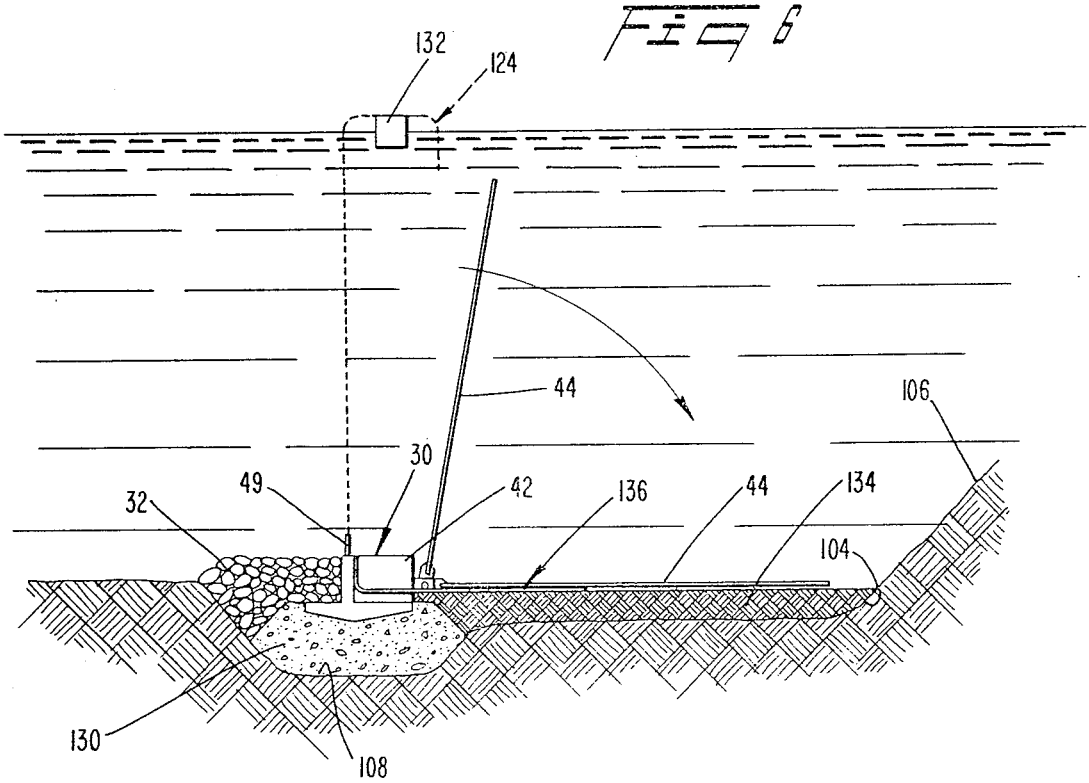
FIG. 6 is a cross-sectional view illustrating lowering of the reinforcing members.

When the space between the footer panel 30 and the trench 108 have been completely filled with crushed rock 130 (see FIG. 6), concrete or any other suitable foundation supporting material, the lifting bridle is removed from the footer panel 30 and the guide cables 124 are supported by a suitable conventional buoy 132. In this fashion, the cables 124 are available to indicate the position of the various connecting pins 48, 50.

The area immediately in front of the footer panel 30 is then filled with heavy rock 32 for protection. This protecting material can be deposited to a level approximately co-extensive with the top of the footer panel 30. Next, a layer of drainage material 134 such as gravel or other material that is large enough not to wash away is positioned and spread behind the footer panels 30. The drainage material 134 is deposited to a height corresponding approximately to the pivotal connection between the reinforcing members 44 and the buttress portion 42. At this point, a geotextile sheet 136 is spread on top of the layer of drainage material 134 and so as to be in contact with the rear face of the footer panel 30. The geotextile sheet prevents the fine fill that is to be placed above it from passing into the coarser fill below.

The next step involves lowering the first layer of reinforcing members 44 into position on top of the layer of drainage material 134. This can be effected by simply releasing the reinforcing members 44 and allowing gravity to drop them into proper position on top of the layer of drainage material therebelow.

Figure 9:
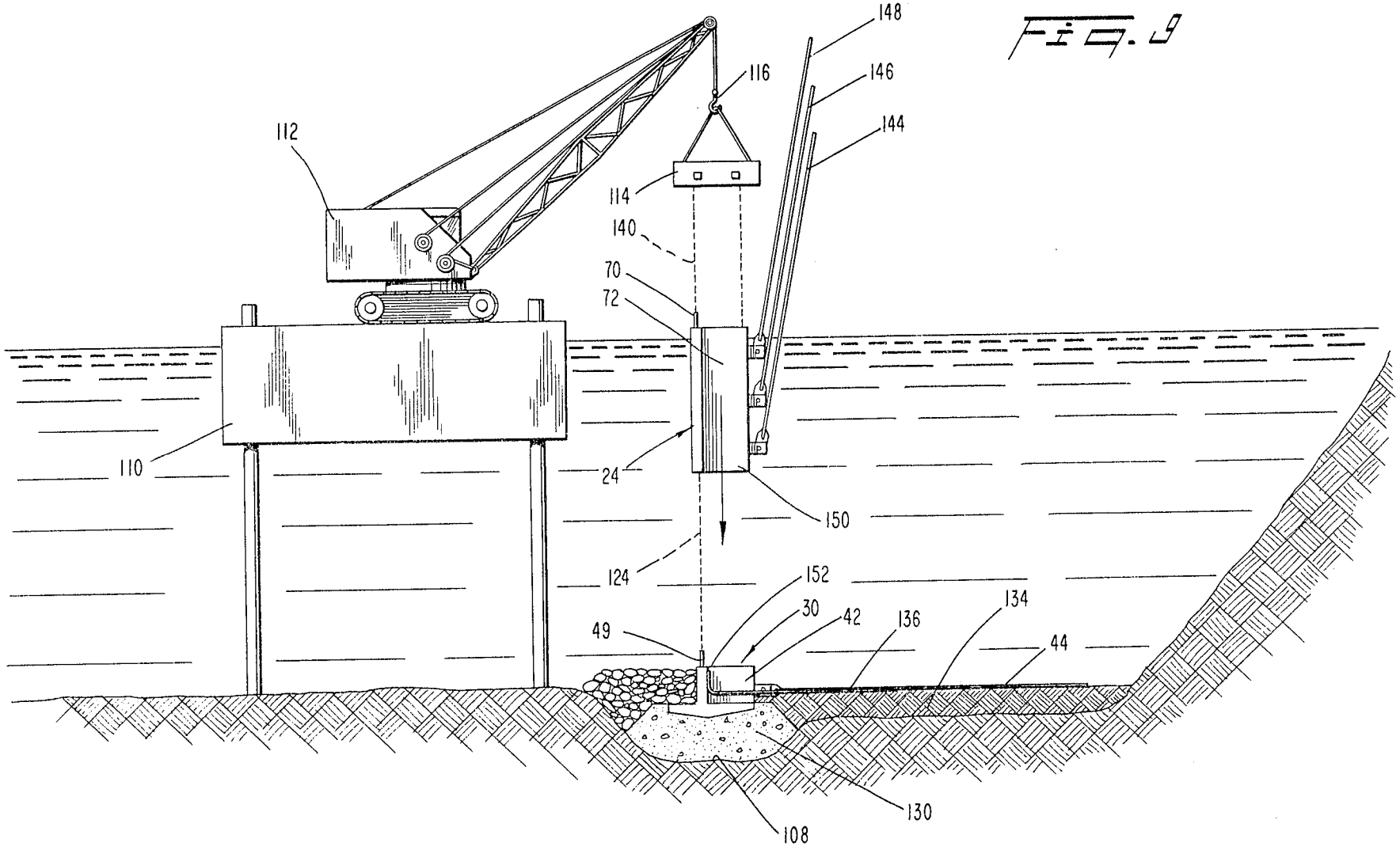
FIG. 9 is a schematic view illustrating placement of the first course of wall panels.

The first course of wall panels 24 (see FIG. 9) is then positioned one at a time on the footer panels 30. The cables 124 can be passed vertically upwardly through the apertures of the projecting end portions of the wall panel 24 so as to guide the wall panel vertically into proper position with respect to the connecting pins 48, 50 carried by the associated footer panel 30. A lifting bridle 140 is used which in turn is supported by a spreader beam 142. The spreader beam 142 has a length which conforms to the length of the wall panels;

whereas the spreader panel 114 has a length which conforms to the length of the footer panels.

While the spreader beam 142 holds the wall panel 24 by means of the lifting sling 140, the cables 140 guide the wall panel as it is lowered beneath the water toward its position on the footer panel 30. While the wall panel 24 is being lowered, the three associated rows of reinforcing members 144, 146, 148, remain in the upwardly swung position so as to be generally parallel to the front face of the wall panel 24. When the wall panel 24 has been fully lowered, the bottom surface 150 thereof rests upon the top surface 152 of the footer panel 30. In this posture, the vertical ribs 72 of the wall panel are in vertical alignment with and laterally coextensive with the corresponding buttress portions 42 of the footer panel 30. Accordingly, since the vertical ribs 72 project from the wall panel by a distance considerably greater than the thickness of the face portion of the wall panel, the center of gravity of the wall panel is more centrally located. Thus, the wall panel has enhanced stability against tipping after it has been positioned on the footer panel.

With the first course of wall panels 24 positioned on the footer panels 30, a layer of particulate material is spread on top of the reinforcing members 44 until it approximately attains the level of the connection between the reinforcing members 144 and the wall panel 24. At this point, the first array of three reinforcing members 144 is released and allowed to pivotally lower onto the top surface of the next layer of particulate material. Thereafter, a subsequent layer of particulate material is deposited until it attains the level of the second array of reinforcing members 146 attached to the wall panel 24. At that time, the second array of reinforcing members 146 is allowed to lower itself, or drop, into the water into a generally horizontal position on top of the second layer or lift of particulate material.

The next step involves again depositing a layer of particulate material between the wall panel 24 and the shore line until the level of material reaches the connections between the third array of reinforcing members 148 and the wall panel 24. As with the first two horizontal arrays of reinforcing members, when the level of the particulate material reaches the connection between reinforcing members 148 and the wall panel 24, the reinforcing members 148 are released and allowed to drop into generally horizontal position, extending rearwardly from the wall panels.

In a similar manner, the second and any subsequent courses of wall panels 24 are lowered into position on top of the next lower course. For example, in FIG. 10, the second course of wall panels has now been positioned and guided by means of the cables 124 into position on the wall. As can be seen, the reinforcing members 156 project upwardly out of the water. This provides a visual indication of the progress of construction along the submerged portion of the wall. For example, the lateral extent of the upwardly projecting reinforcing members 156 will give a visual indication of how far the construction work has progressed along the length of the wall. Moreover, the height to which the reinforcing members 156 project above the surface of the water will give an indication of how high the submerged portion of the wall is at each particular location.

Figure 11:
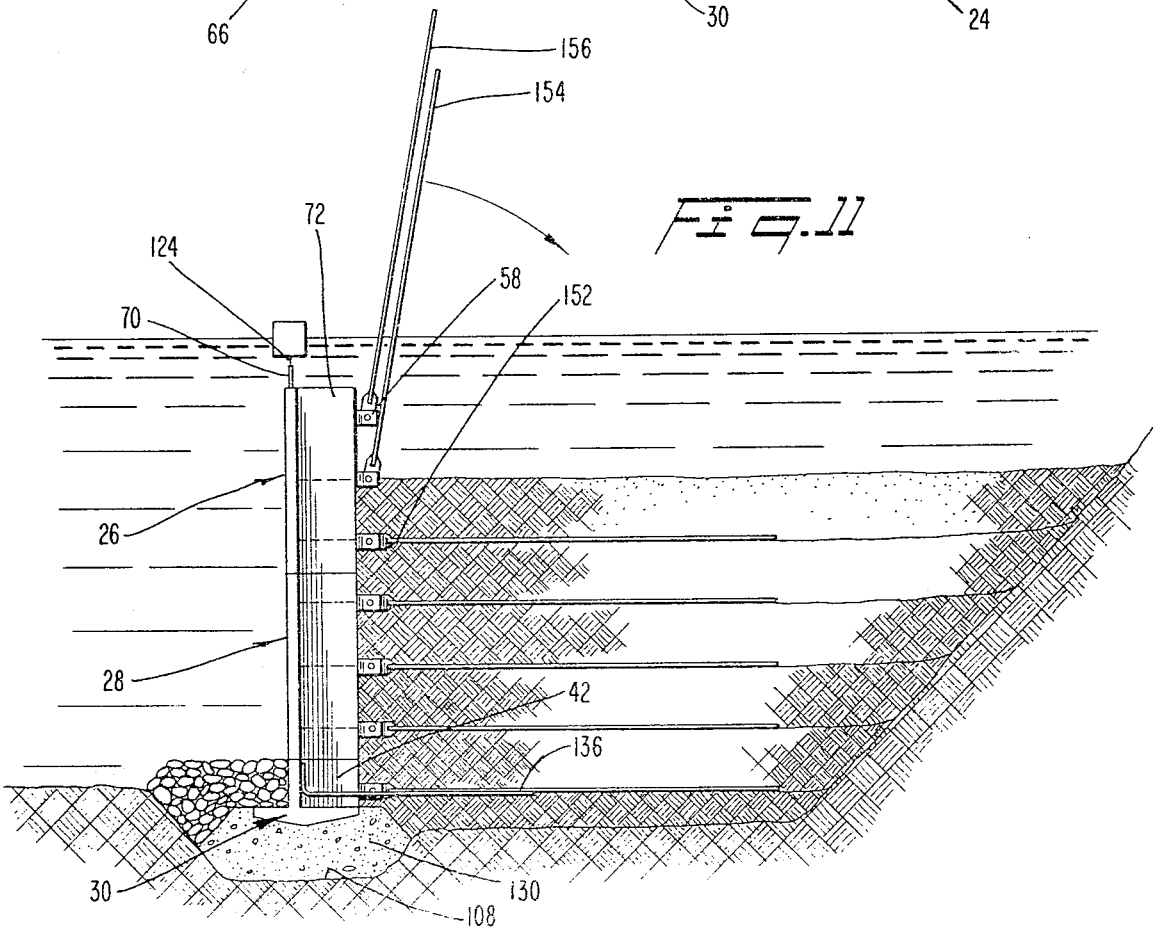
FIG. 11 is a cross-sectional view taken through the wall at a time when two courses of wall panels have been erected.

As with the reinforcing members 144, 146, 148 of the first course of wall panels 24, the subsequent steps in the construction of the wall involve interdigitating layers of particulate material with the reinforcing members 152, 154, 156 (FIG. 11) behind the second course of wall panels.

Figure 12:
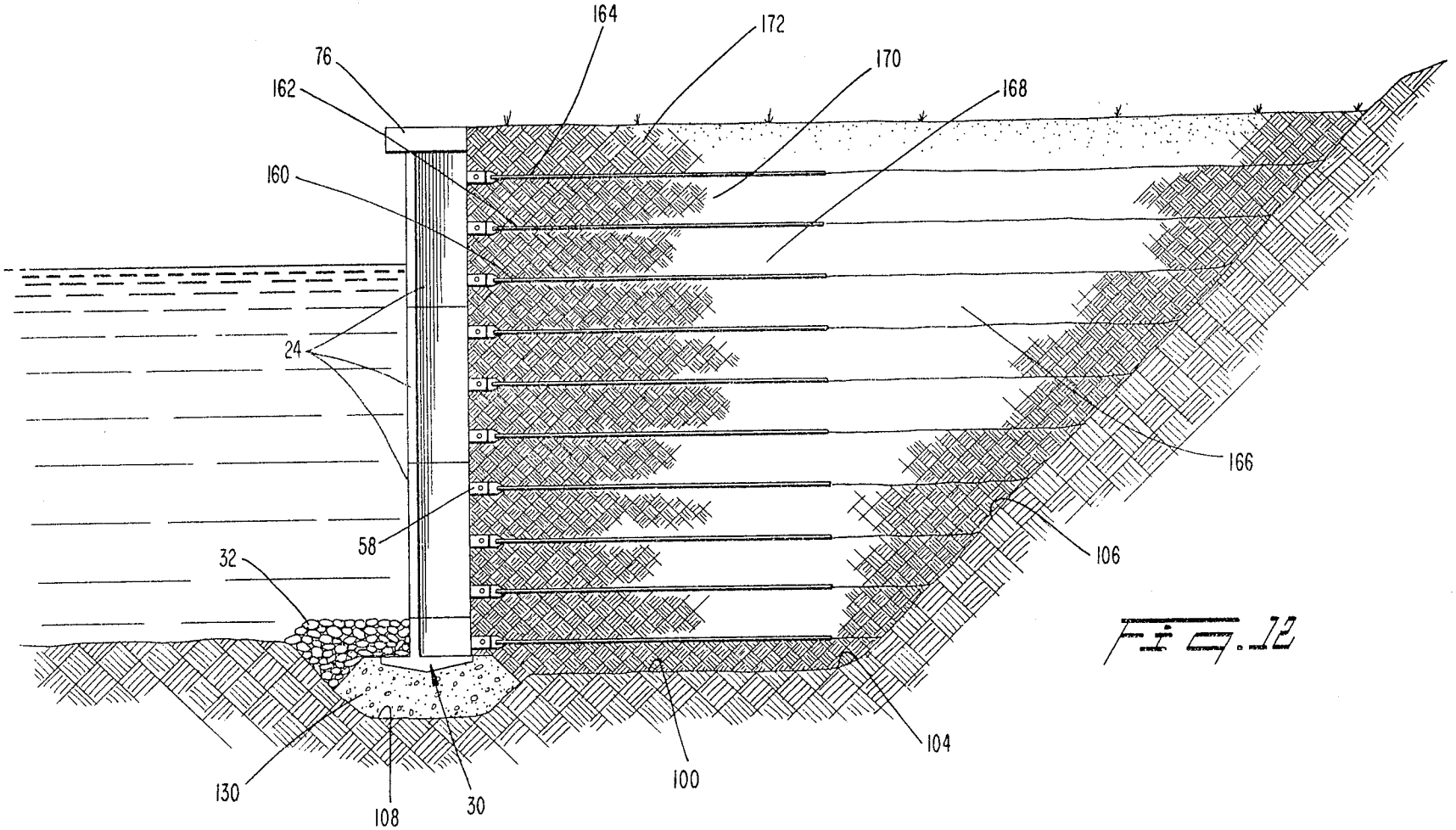
FIG. 12 is a cross-sectional view through a completed wall.

For a wall constructed in accordance with the illustrations, only three courses of wall panels (see FIG. 12) are necessary to bring the top of the wall above the surface of the water. The third and final course of wall panels is positioned and lowered into place on the wall in the same fashion as described above in connection with the first course 28 and the second course 26. Moreover, the horizontal arrays of reinforcing members 160, 162, 164 (see FIG. 12) are lowered into position on corresponding layers of particulate material 166, 168, 170. The wall is finally topped off with a last layer of particulate material 172.

To finish the wall itself, a cap member 76 is cast in place along the entire length of the seawall. The cap 76 serves to tie together the top portions of the wall. To effect this result, the uppermost course of panels may be provided with a plurality of reinforcing members which project vertically upwardly from the top edge thereof. In this fashion, when the cap is cast in place, it will intimately engage the projecting reinforcing rods and thereby make the top of the wall a cohesive unit.

The foregoing description shows how a marine wall structure erected in accordance with the method and apparatus disclosed herein overcomes the problems and disadvantages associated with the prior art. Moreover, it will be apparent to those skilled in the art that numerous modifications, variations, substitutions and equivalents exist for features of the invention which do not materially depart from the spirit and scope of the invention. Accordingly, it is expressly intended that all those modifications, variations, substitutions and equivalents which do not materially depart from the scope of the invention as recited in the appended claims be embraced thereby.

What is claimed is:

1. A method of erecting a wall in a wet environment, comprising the steps of:

installing a course of footer panels in a submerged location;

placing a course of wall panels on the footer panels, said wall panels having a plurality of reinforcing members hingedly attached thereto;

depositing a layer of particulate material behind the course of wall panels;

swinging said reinforcing members from a generally vertical position with respect to the placed wall panel to a generally horizontal position with respect to the placed wall panel having engagement with said layer of particulate material; and repeating the placing, depositing and swinging steps until the wall reaches the desired height.

2. The method of claim 1 wherein the installing step includes:

laying a foundation on a submerged surface;

suspending each footer panel at a predetermined location above the water surface while positioning the footer panel;

lowering said footer panel to rest on said foundation; and connecting each footer panel to at least one adjacent footer panel in end-to-end relationship.

3. The method of claim 2 wherein said laying step includes:

placing crushed stone beneath each footer panel to support that footer panel on the bottom while suspending that footer panel above the bottom;

backfilling the footer panel with a layer of drainage material.

4. The method of claim 1 wherein:

the installing step further includes positioning a footer panel by reference to a land based positioning device; and the placing step includes guiding the wall panel into position on said footer panel; and connecting each wall panel to the associated footer panel by a pair of pins.

5. An assembly suitable for use in erecting walls in a wet environment comprising:

a wall panel fashioned from reinforced concrete, having a pair of reinforcing members embedded therein;

a pair of members, one end of each member being securely attached to a corresponding one of the reinforcing members, the second end of each member projecting from the wall panel and having an aperture, the apertures of the members being in alignment;

an elongated metal strip provided with a connector and end having an aperture therethrough;

pin means passing through the apertures of the pair of members and through the aperture of the connector end, including means for preventing disengagement of the pin means from the apertures, and the pin means being operable to pivotally connect the metal strip to the wall panel so that upon placement of the wall panel the metal strip can be lowered into position.

6. An assembly suitable for use in erecting walls in a wet environment comprising:

a wall panel fashioned from reinforced concrete, having a pair of reinforcing members embedded therein;

a pair of members, one end of each member being securely attached to a corresponding one of the reinforcing members, the second end of each member projecting from the wall panel and having an aperture, the apertures of the members being in alignment;

an elongated metal strip provided with a connector end having an aperture therethrough;

pin means passing through the apertures of the pair of members and through the aperture of the connector end, including means for preventing disengagement of the pin means from the apertures, and the pin means being operable to pivotally connect the metal strip to the wall panel so that upon placement of the wall panel the metal strip can be lowered into position; and including a plurality of elongated metal strips, each strip having associated therewith corresponding pair of members and corresponding pin means.

7. A wall for use in a wet environment comprising:

a course of submerged footer panels with the panels extending in end-to-end relationship, each footer panel including a front portion, a rear portion and reinforcing members extending from the rear portion;

at least one course of wall panels extending in end-to-end relationship, generally parallel to the course of footer panels and supported thereby, each wall panel having a top portion, a rear portion and a plurality of elongated metal strips attached to the rear portion, the top portion of at least the uppermost course of wall panels extending above the water level of the wet environment; and particulate material surrounding and frictionally engaging the reinforcing members of the footer panels and the elongated metal strips of the wall panels, the particulate material extending from the top to the bottom of the wall.

* * * * *